US005699812A

United States Patent [19]

Bowen et al.

[11] Patent Number: 5,699,812

[45] Date of Patent: *Dec. 23, 1997

[54] SMOKING PRODUCT

[75] Inventors: Larry Bowen, Orangeville; George Edward Ayres, Campbellville; Gary Black, Brampton; Jacques Daoust, St. Sophie, all of Canada

[73] Assignee: Rothmans, Benson & Hedges Inc.

[*] Notice: The term of this patent shall not extend beyond the expiration date of Pat. No. 5,462,073.

[21] Appl. No.: 460,276

[22] Filed: Jun. 2, 1995

Related U.S. Application Data

[63] Continuation of Ser. No. 181,975, Jan. 18, 1994, Pat. No. 5,462,073.

[30] Foreign Application Priority Data

| | | | |
|---|---|---|---|
| Jan. 5, 1991 | [GB] | United Kingdom | 9100196 |
| Feb. 14, 1991 | [GB] | United Kingdom | 9103202 |
| Apr. 24, 1991 | [GB] | United Kingdom | 9108783 |
| May 16, 1991 | [GB] | United Kingdom | 9110559 |
| Jul. 5, 1991 | [GB] | United Kingdom | 9114598 |

[51] Int. Cl.[6] ..... A24B 15/25

[52] U.S. Cl. ..... 131/374; 131/297

[58] Field of Search ..... 131/358, 370, 131/374, 373, 297

[56] References Cited

U.S. PATENT DOCUMENTS

| | | | |
|---|---|---|---|
| 2,150,512 | 3/1939 | May | 131/52 |
| 3,043,723 | 7/1962 | Cleverdon | 131/17 |
| 3,416,537 | 12/1968 | Townend | 131/140 |
| 3,429,316 | 2/1969 | Hess | 131/17 |
| 4,092,987 | 6/1978 | Imbert | 131/8 R |
| 4,244,381 | 1/1981 | Lendvay | 131/17 A |
| 4,407,308 | 10/1983 | Baker et al. | 131/336 |
| 4,481,960 | 11/1984 | Brooks | 131/336 |
| 4,489,738 | 12/1984 | Simon | 131/349 |
| 4,615,345 | 10/1986 | Durocher | 131/365 |
| 4,962,774 | 10/1990 | Thomasson et al. | 131/309 |
| 4,984,589 | 1/1991 | Riedesser | 131/365 |
| 5,056,537 | 10/1991 | Brown et al. | 131/352 |
| 5,462,073 | 10/1995 | Bowen et al. | 131/374 |

FOREIGN PATENT DOCUMENTS

| | | | |
|---|---|---|---|
| 175148 | 6/0000 | Australia | 131/365 |
| 1083909 | 8/1980 | Canada | 131/336 |
| 1097900 | 3/1981 | Canada | 131/349 |
| 1171748 | 7/1984 | Canada | 131/349 |
| 2004102 | 5/1990 | Canada | 131/336 |
| 2013427 | 9/1990 | Canada | 131/349 |

*Primary Examiner*—Vincent Millin
*Assistant Examiner*—Charles W. Anderson
*Attorney, Agent, or Firm*—Sim & McBurney

[57] ABSTRACT

A novel reconstituted tobacco sheet material is provided which is useful in providing a novel smoking product which has a smoking quality closely approximating that of cigarettes having conventional paper wrappers. The reconstituted tobacco sheet is prepared by a paper-making process in which the water-soluble material extracted in the paper-making process is not added back to the sheet, or if added back, to an extent of no more than 20 wt % of the reconstituted tobacco sheet. In the novel smoking product, a tobacco filler rod is enclosed within an outer wrapper, which usually comprises an inner binder layer and an outer wrapper layer, one or both formed of reconstituted tobacco sheet material. When the tobacco filler rod is double-wrapped, the novel smoking product also exhibits a significant reduction in sidestream smoking production in comparison to a conventionally-wrapped cigarette. The reconstituted tobacco sheet material has a porosity of at least about 50 Coresta units and contains about 0 to about 20 wt % of conventional chalk-type fillers.

38 Claims, 1 Drawing Sheet

SMOKING PRODUCT

This is a continuation of application Ser. No. 08/181,975 filed Jan. 18, 1994, now U.S. Pat. No. 5,462,073.

FIELD OF INVENTION

The present invention relates to reconstituted tobacco sheet which is useful in the provision of a novel smoking product which exhibits smoking characteristics similar to conventional cigarettes, preferably with decreased sidestream smoke production.

BACKGROUND TO THE INVENTION

Cigarettes generally comprise a cut tobacco filler rod having a paper wrapper enclosing the rod and often a tobacco smoke filter at one end. The present invention is concerned, in one aspect, with providing a novel smoking product which is wrapped in a reconstituted tobacco sheet and which has a smoking quality closely approximating that of a cigarette having a conventional paper wrapper.

Cigarettes exhibit a considerable visible sidestream smoke production, that is, when the cigarette is at rest between puffs by the smoker, visible smoke is generated from the continued burning of the cigarette, and such sidestream smoke can be irritating to some non-smokers. Attempts have been made in the past to develop cigarettes which exhibit a decreased visible sidestream smoke production. Such attempts have included incorporation of special additives to cigarette paper and employing cigarette papers with special burn characteristics in a double-wrapping of the tobacco filler rod.

However, such attempts, while successful to some degree in decreasing sidestream smoke production, have not led to a product which has smoking taste characteristics which are acceptable to the smoker. In one preferred embodiment of the invention, as described in detail below, there is provided a cigarette which not only exhibits a significant decrease in sidestream smoke production when compared to conventional cigarettes but also possesses smoking taste characteristics similar to conventional cigarettes.

Cigars normally are formed of a tobacco filler rod of threshed pieces of air-cured tobacco, which also may be partially fermented, or also contain reconstituted leaf tobacco, wrapped in two wrappers, first a binder (inner wrapper) and then an outer wrapper, either in a spiral wind or longitudinal design. Both the binder and the wrapper layers may be natural tobacco or formed of reconstituted leaf tobacco. Some cigars have a mouthpiece or a filter. Cigars have a distinctive smoking taste, quite different from conventional cigarettes.

SUMMARY OF INVENTION

In one aspect of the invention, there is provided a reconstituted tobacco sheet material, which is useful as either or both the wrapper layer and binder layer of a smoking product, and which is formed in such a way that a novel smoking product may be provided which has a smoking quality closely approximating that of conventional cigarettes. The novel reconstituted tobacco sheet may also be employed to provide a cigarette with decreased sidestream smoke production.

To provide the, results, the novel reconstituted tobacco sheet is one which is formed from tobacco material as the principal fibre constituent by a paper-making process in which water-soluble material extracted from the tobacco in the sheet-making process is not added back to the sheet unless in an amount which does not exceed about 20 wt % of the reconstituted sheet.

In another aspect, the present invention provides a novel smoking product comprising a tobacco filler rod and a wrapper enclosing the tobacco filler rod and comprising the reconstituted tobacco sheet.

The term "wrapper" is used herein to denote an enclosure to the tobacco filler rod and may comprise a single layer of the reconstituted tobacco sheet material, as in a conventional cigarette, or two superimposed layers, at least one of which, preferably both, is provided by the reconstituted tobacco sheet, as in a conventional cigar, and termed "a wrapper layer" (the outer layer) and "a binder layer" (the inner layer).

In both cases, i.e. a single layer or double layer wrapped tobacco filler rod, the novel smoking product exhibits a smoking quality closely approximating that of conventional cigarettes. In the case where there is a double wrapping, the novel smoking product also exhibits a significant decrease in visible sidestream smoke production.

In one particular embodiment of the invention, the novel smoking product comprises an elongate cylinder comprised substantially of flue-cured tobacco and a tobacco smoke filter at one end of the elongate cylinder. The elongate cylinder comprises a flue-cured tobacco filler rod and a wrapper, as defined above, enclosing the tobacco filler rod.

The wrapper employed in the novel smoking product of the invention preferably has overlapping circumferential extremities which are adhered to each other along a line parallel to the axis of the elongate cylinder. In one embodiment, a spiral-wound wrapper may be employed.

GENERAL DESCRIPTION OF INVENTION

Figure 1:
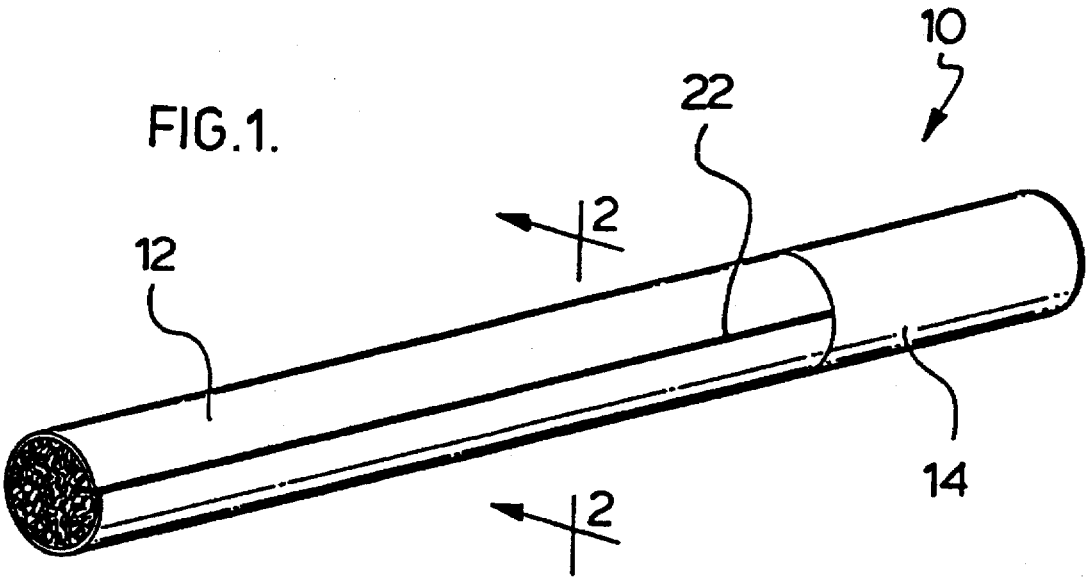
FIG. 1 is a perspective view of a smoking product constructed in accordance with one embodiment of the invention.

As set forth above, the present invention provides a novel form of reconstituted tobacco sheet and novel smoking products formed therefrom. It has been found that, if the sheet is manufactured by a paper making process and formed from tobacco material, which may include stem, stalk and fines, and that, if water-soluble material usually extracted in the sheet-forming process, is not added back to the sheet, as would otherwise be the case in such a process, then a reconstituted tobacco sheet is provided which, when used to enclose a tobacco filler rod, either as a single wrapper or as the wrapper layer and/or binder layer of a double wrapper, results in a smoking product having a smoking quality which closely resembles that of cigarettes having conventional paper wrappers. This result is not experienced in the conventional method of forming such sheet where all or most of the water-soluble material is added back.

The novel smoking product of the present invention is a tobacco wrapped product which has the taste characteristics of conventional cigarettes, while the novel tobacco wrapping material is one which provides such taste characteristics. In one broad aspect, therefore, the present invention provides a smoking product having a smoking quality closely approximating that of cigarettes having conventional paper wrappers and comprising a tobacco filler rod, a wrapper (as defined above) of reconstituted tobacco sheet enclosing the tobacco filler rod, and a tobacco smoke filter at one end of the tobacco filler rod.

A particularly preferred feature of this novel smoking product, wherein the wrapper comprises both a wrapper layer and a binder layer, is that it exhibits a significant decrease in visible sidestream smoke production, in comparison to a conventionally-wrapped cigarette and cigar, as described in more detail below. The novel reconstituted tobacco sheet material, therefore, enables the production, for the first time, of a low sidestream smoke smoking product which has the smoking characteristics of conventional cigarettes.

A method for forming reconstituted tobacco sheet by a paper-making process is described in U.S. Pat. No. 4,182,349 and reference may be made thereto for details of the process. As described therein, a pulp of tobacco materials, including fibrous material, after separation from water-soluble material, is fed to a fourdrinier wire on which the reconstituted tobacco sheet is formed. Normally, the water-soluble material previously extracted from the tobacco in the pulp-preparation step, is added back onto the sheet before it is dried. As noted above, in the present invention, this step is not effected or, if effected, only to the extent that the water-soluble material constitutes no more than about 20 wt % of the final sheet.

The reconstituted tobacco sheet conventionally used for cigar wrapper and binder usually has a basis weight of about 40 grams per square meter ($g/m^2$). It is a feature of this invention that preferred smoking characteristics are obtained by significantly decreasing the basis weight oft he sheet. Specifically, either the wrapper or the binder or both preferably has a basis weight of less than about 35 $g/m^2$ and the total basis weight of the wrapper and binder preferably is less than about 70 $g/m^2$.

The reconstituted tobacco sheet also preferably possesses a porosity of at least about 50 Coresta units, more preferably at least about 150 Coresta units, and most preferably about 150 to about 250 Coresta units. The provision of a wrapper formed of reconstituted tobacco and having a basis weight of less than about 35 $g/m^2$ and a porosity of at least about 50 Coresta units constitutes a preferred embodiment of the invention.

Additional desirable burning characteristics can be achieved by incorporating into the reconstituted tobacco sheet a conventional chalk-type filler, generally in an amount of about 10 to about 20 wt %, preferably about 14 to about 16 wt %.

The smoking product having the novel construction provided herein has the physical form and visual appearance of a cigar, while possessing a conventional cigarette smoking taste. The product exhibits a significant reduction in sidestream odour in comparison to a cigar.

The use of the reconstituted tobacco sheet as the wrapper layer, binder layer or, preferably, both wrapper and binder layers, of a double-wrapped tobacco filler rod results in a smoking product which exhibits a significant decrease in visible sidestream smoke in comparison to a cigarette having a conventional paper wrapper, generally a decrease of about 30 to about 60%, and in comparison to a conventional cigarette. Where the reconstituted tobacco sheet comprises one of the wrapper and binder layer, it usually comprises the binder layer and the wrapper layer is provided by conventional cigarette paper.

As far as the applicants are aware, such double-wrapped smoking product constitutes the first smoking product to exhibit both an acceptable cigarette-like taste and a significant reduction in sidestream smoke.

The tobacco filler material used in the smoking product may be comprised of flue-cured tobacco, air-cured tobacco, or blends thereof, which may be finely-cut (typically 33 cuts/inch), coarsely-cut (typically 12 cuts/inch), or pieces.

The tobacco filler material may include a proportion of expanded tobacco, if desired, preferably about 20 to about 25 wt % expanded tobacco. The tobacco filler material also may include a proportion of processed tobacco stem material, which may be shredded enhanced stem or cut-rolled stem, generally not exceeding about 5 wt %.

The tobacco filler rod preferably is enclosed within a binder layer and a wrapper layer both composed of reconstituted tobacco sheet formed by a paper-making process and having a content of added-back water-soluble extracts less than about 20% by weight of the final reconstituted tobacco sheet. Such reconstituted tobacco sheet generally comprises about 66% or greater tobacco material, the balance being cellulosic material, inorganic materials and ash conditioners.

The binder layer of the double tobacco-wrapped smoking product generally is of a slightly-narrower transverse dimension than the wrapper layer, to allow the circumferential ends of the wrapper layer to overlap and to be adhered together along a longitudinal glue line, thereby enclosing the binder layer and tobacco filler rod, while the circumferential ends of the binder layer substantially abut one another.

In the assembly of the novel smoking product, the binder layer and wrapper layer usually are applied as a web of superimposed elements to a continuous tobacco filler rod in a single wrapping operation in a cigarette-making machine to enclose the filler rod and form a continuous rod, from which individual smoking sticks are cut and filters applied to form individual filter-tipped elements, in conventional manner. However, in this invention, either the binder layer or wrapper layer or both, each or one being constituted by the novel reconstituted tobacco sheet material, may be applied in a spirally-wound manner.

DESCRIPTION OF PREFERRED EMBODIMENT

Referring to the drawings, a smoking product 10 constructed in accordance with a preferred embodiment of the invention, comprises an elongate cylinder 12, which preferably is comprised substantially of flue-cured tobacco, and a smoke filter 14 at one end of the elongate cylinder.

Figure 2:
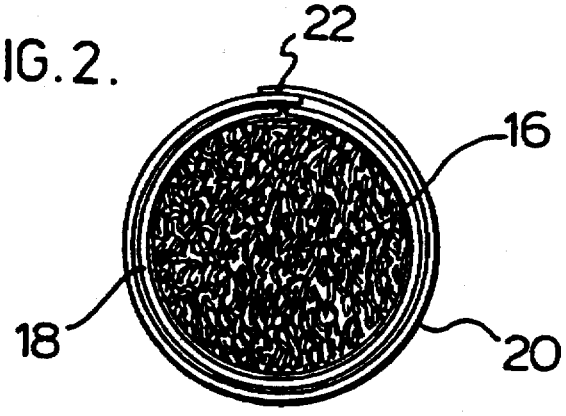
FIG. 2 is a sectional view taken on line 2—2 of FIG. 1.

As may be seen from FIG. 2, the elongate cylinder 12 comprises a tobacco filler rod 16 of tobacco and a wrapper comprising an inner binder layer 18 and an outer wrapper layer 20, both formed of reconstituted tobacco sheet.

The reconstituted tobacco sheet is formed by a paper-making process to which water-soluble material extracted from the tobacco in the sheet forming process is not added back to the sheet, or if added back, only to the extent of no more than 20 wt % of the reconstituted tobacco sheet. The reconstituted tobacco sheet also may have the combination of basis weight, porosity and filler content discussed above.

The outer wrapper layer 20 has overlapping circumferential extremities which are joined together along a longitudinal glue line 22 and encloses the inner binder layer 18. The inner binder layer 18, which encloses the tobacco filler rod 16, has a narrower transverse dimension than the outer wrapper layer 18, such that the circumferential extremities of the binder layer 18 substantially abut.

SUMMARY OF DISCLOSURE

In summary of this disclosure, the present invention provides a novel reconstituted tobacco sheet material which enables a tobacco-wrapped product to be provided which possesses a smoking quality closely approximating that of conventional cigarettes, and which, when a double-wrap of such sheet material is employed, exhibits a significant reduction in visible sidestream smoke production. Modifications are possible within the scope of this invention.

What we claim is:

1. A smoking product having a smoking quality closely approximating that of a cigarette having a conventional paper wrapper, which comprises:

a tobacco filler rod, and a wrapper enclosing the tobacco filler rod, said wrapper comprising an inner binder layer of reconstituted tobacco sheet and an outer wrapper of conventional cigarette paper, said reconstituted tobacco sheet being formed by a paper-making process in which water-soluble material extracted in the sheet making process is not added back to the sheet unless in an amount which does not exceed about 20 wt % of the reconstituted sheet, said cigarette exhibiting a decrease in sidestream smoke production of about 30 to about 60% in comparison to a cigarette having the conventional cigarette wrapper.

2. A smoking product having a smoking quality closely approximating that of a cigarette having a conventional paper wrapper, which comprises:

a tobacco filler rod, and a wrapper enclosing the tobacco filler rod, said wrapper comprising an inner binder layer and an outer wrapper layer of reconstituted tobacco sheet, said reconstituted tobacco sheet being formed by a paper-making process in which water-soluble material extracted in the sheet making process is not added back to the sheet unless in an amount which does not exceed about 20 wt % of the reconstituted sheet, said cigarette exhibiting a decrease in sidestream smoke production of about 30 to about 60% in comparison to a cigarette having the conventional cigarette wrapper.

3. The smoking product of claim 2 wherein said outer wrapper layer has overlapping circumferential extremities which are adhered to each other along a longitudinal glue line parallel to a longitudinal axis of the tobacco filler rod.

4. The smoking product of claim 3 wherein said inner binder layer has a slightly narrower transverse dimension than the outer wrapper layer to permit said circumferential extremities of said outer wrapper layer to overlap along said longitudinal glue line to enclose said inner binder layer and said tobacco filler rod.

5. The smoking product of claim 2 wherein at least one of the inner binder layer and outer wrapper layer has a basis weight of less than about 35 $g/m^2$ and the inner binder layer and outer wrapper layer have a total basis weight which is less than about 70 $g/m^2$.

6. The smoking product of claim 5 wherein said inner binder layer and outer wrapper layer are formed of reconstituted tobacco sheet having a porosity of at least about 50 Coresta units.

7. The smoking product of claim 2 wherein said reconstituted tobacco sheet comprises at least about 66 wt % of tobacco.

8. The smoking product of claim 2 wherein at least one of the binder layer and wrapper layer is spirally wound.

9. A smoking product, comprising:

an elongate cylinder comprised substantially of flue-cured tobacco, and a tobacco smoke filter at one end of the elongate cylinder, said elongate cylinder comprising a tobacco filler rod of flue-cured tobacco and a wrapper enclosing the tobacco filler rod and being a reconstituted tobacco sheet formed from flue-cured tobacco by a paper making process in which water-soluble material extracted in the sheet-making process is not added back to the sheet unless in an amount which does not exceed about 20 wt % of the reconstituted sheet.

10. A smoking product having a smoking quality closely approximating that of a cigarette having a conventional paper wrapper, comprising:

an elongate cylinder comprised of tobacco, and a tobacco smoke filter at one end of the elongate cylinder, said elongate cylinder comprising a tobacco filler rod and a wrapper enclosing said elongate cylinder and comprising an inner binder layer and an outer wrapper layer, at least one of said inner binder layer and outer wrapper layer being formed of reconstituted tobacco sheet formed by a paper-making process in which water-soluble material extracted in the sheet-forming process is not added back to the sheet unless in an amount which does not exceed about 20 wt % of the reconstituted sheet, whereby said smoking product exhibits a decrease in sidestream tobacco smoke production of about 30 to about 60% in comparison to a cigarette having a conventional paper wrapper.

11. The smoking product of claim 10 wherein said inner binder layer is formed of reconstituted tobacco sheet and said outer wrapper layer is formed of conventional cigarette paper.

12. The smoking product of claim 10 wherein both said inner binder layer and said outer wrapper layer are formed of said reconstituted tobacco sheet.

13. The smoking product of claim 11 or 12 wherein said reconstituted tobacco sheet comprises at least about 66 wt % of tobacco.

14. The smoking product of claim 11 or 12 wherein said reconstituted tobacco sheet has a porosity of at least about 50 Coresta units.

15. The smoking product of claim 14 wherein said reconstituted tobacco sheet comprises about 10 to about 20 wt % of conventional chalk-type filler.

16. The smoking product of claim 11 or 12 wherein said reconstituted tobacco sheet has a porosity of at least about 150 Coresta units.

17. The smoking product of claim 11 or 12 wherein said reconstituted tobacco sheet has a porosity of about 150 to about 250 Coresta units.

18. The smoking product of claim 17 wherein said reconstituted tobacco sheet comprises about 14 to about 16 wt % of conventional chalk-type filler.

19. The smoking product of claim 10 wherein said elongate cylinder is comprised substantially of flue-cured tobacco.

20. The smoking product of claim 10 wherein said tobacco filler rod contains up to about 5 wt % of processed tobacco stem material.

21. The smoking product of claim 20 wherein said tobacco filler rod contains about 20 to about 25 wt % of expanded tobacco.

22. The smoking product of claim 10 wherein at least one of said binder layer and wrapper layer is spirally wound.

23. The smoking product of claim 10 wherein said wrapper layer has overlapping circumferential extremities which are adhered to each other along a longitudinal glue line parallel to a longitudinal axis of the tobacco filler rod.

24. A smoking product, comprising:

a tobacco filler rod enclosed within an inner binder layer and an outer wrapper layer of reconstituted tobacco sheet, wherein said outer wrapper layer has overlapping circumferential extremities which are adhered to each other along a longitudinal glue line parallel to the axis of the filler rod, said reconstituted tobacco sheet in said inner binder layer and outer wrapper layer having the following characteristics:

(a) a porosity of at least about 50 Coresta units, (b) being formed by a paper-making process in which water-soluble material extracted in the sheet making process is not added back to the sheet unless in an amount which does not exceed about 20% of the reconstituted sheet, and (c) a content of conventional chalk-type filler of about 10 to about 20 wt %.

25. The smoking product of claim 24, wherein said filler content is about 14 to about 16 wt %.

26. The smoking product of claim 25 wherein said reconstituted tobacco sheet has a porosity of about 150 to about 250 Coresta units.

27. The smoking product of claim 26 wherein said reconstituted tobacco sheet comprises at least about 66 wt % of tobacco material.

28. The smoking product of claim 27 wherein said reconstituted tobacco sheet has a basis weight of less than about 35 $g/m^2$.

29. The smoking product of claim 24 wherein said reconstituted tobacco sheet has a porosity of at least about 150 Coresta units.

30. The smoking product of claim 24 having a tobacco smoke filter at one end.

31. The smoking product of claim 24 formed substantially of flue-cured tobacco.

32. A smoking product having a smoking quality closely approximating that of a cigarette having a conventional paper wrapper and exhibiting a significant reduction in sidestream smoke production in comparison with a cigarette having a conventional paper wrapper, comprising:

a tobacco filler rod enclosed within an inner binder layer and an outer wrapper layer of reconstituted tobacco sheet, wherein said outer wrapper layer has overlapping circumferential extremities which are adhered to each other along a longitudinal glue line parallel to the axis of the filler rod, and a tobacco smoke filter at one end of said tobacco filler rod, said tobacco filler rod comprising up to about 5 wt % of processed stem material and about 20 to about 25 wt % of expanded tobacco, said reconstituted tobacco sheet in said inner binder layer and outer wrapper layer having the following characteristics:

(a) a porosity of at least about 50 Coresta units, (b) being formed by a paper-making process in which water-soluble material extracted in the sheet making process is not added back to the sheet unless in an amount which does not exceed about 20% of the reconstituted sheet, and (c) a content of conventional chalk-type filler of about 10 to about 20 wt %.

33. The smoking product of claim 32 wherein said tobacco filler rod is comprised of coarsely-cut tobacco.

34. The smoking product of claim 33 wherein said filler rod comprises flue-cured tobacco.

35. A smoking product having a smoking quality closely approximating that of a cigarette having a conventional paper wrapper and comprising a tobacco filler rod, a wrapper of reconstituted tobacco sheet enclosing the tobacco filler rod, and a tobacco smoke filter at one end of said tobacco filler rod.

36. The smoking product of claim 35 having a wrapper comprising an inner binder layer of said reconstituted tobacco sheet and an outer wrapper of a conventional cigarette paper and exhibiting a significant reduction in sidestream smoke production in comparison to a cigarette having a conventional paper wrapper alone.

37. The smoking product of claim 35 having a wrapper comprising an inner binder layer and an outer wrapper layer both of said reconstituted tobacco sheet and exhibiting a significant reduction in sidestream smoke production in comparison to a cigarette having a conventional paper wrapper.

38. The smoking product of claim 36 or 37 wherein said reduction in sidestream smoke is about 30 to about 60%.

* * * * *